US007645119B2

(12) United States Patent
Nomura et al.

(10) Patent No.: US 7,645,119 B2
(45) **Date of Patent: *Jan. 12, 2010**

(54) AXIAL FLOW TURBINE

(75) Inventors: Daisuke Nomura, Kanagawa-ken (JP); Sakae Kawasaki, Kanagawa-ken (JP); Akihiro Onoda, Kanagawa-ken (JP); Kentaro Tani, Kanagawa-ken (JP); Hiroshi Kawakami, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 181 days.

This patent is subject to a terminal disclaimer.

(21) Appl. No.: 11/892,375

(22) Filed: Aug. 22, 2007

(65) Prior Publication Data

US 2008/0199310 A1 Aug. 21, 2008

Related U.S. Application Data

(63) Continuation of application No. 11/392,956, filed on Mar. 30, 2006, now Pat. No. 7,300,247.

(30) Foreign Application Priority Data

Mar. 31, 2005 (JP) ..... 2005-104056

(51) Int. Cl.
*F01D 9/02* (2006.01)

(52) U.S. Cl. ..... 415/191; 415/199.5; 415/211.2

(58) Field of Classification Search ..... 415/191, 415/199.5, 211.2, 199.4
See application file for complete search history.

(56) References Cited

U.S. PATENT DOCUMENTS

| | | | | |
|---|---|---|---|---|
| 5,088,892 | A | 2/1992 | Weingold et al. | |
| 5,947,683 | A * | 9/1999 | Kobayashi | 415/208.1 |
| 6,126,394 | A | 10/2000 | Matsuda | |
| 6,312,219 | B1 | 11/2001 | Wood et al. | |
| 6,354,798 | B1 * | 3/2002 | Deckers | 415/192 |
| 6,491,493 | B1 | 12/2002 | Watanabe et al. | |
| 6,508,630 | B2 * | 1/2003 | Liu et al. | 416/228 |
| 7,300,247 | B2 * | 11/2007 | Nomura et al. | 415/191 |

FOREIGN PATENT DOCUMENTS

| | | | |
|---|---|---|---|
| CN | 1163662 | C | 8/2004 |
| JP | 10-061405 | A | 3/1998 |
| JP | 2002-517666 | A | 6/2002 |

* cited by examiner

*Primary Examiner*—Ninh H Nguyen
(74) *Attorney, Agent, or Firm*—Foley & Lardner LLP

(57) ABSTRACT

An axial flow turbine provided with a stage composed of a turbine nozzle and a turbine rotor blade arranged in an axial flow direction. Both end portions of a nozzle blade of the turbine nozzle are supported by a diaphragm inner ring and a diaphragm outer ring, and a flow passage is formed to have its diameter expanded from an upstream stage to a downstream stage. In such axial flow turbine, trailing edges at ends of the nozzle blade supported by the diaphragm inner ring and the diaphragm outer ring are curved as a curvature to an outlet side, and an intermediate portion between the trailing edges is formed to be straight.

9 Claims, 7 Drawing Sheets

AXIAL FLOW TURBINE

CROSS-REFERENCE TO RELATED APPLICATIONS

The present application is a continuation based upon U.S. application Ser. No. 11/392,956 filed Mar. 30, 2006; the entire contents of all of which are incorporated herein by reference.

BACKGROUND OF THE INVENTION

1. Field of the Invention

The present invention relates to an axial flow turbine, and more particularly, to an axial flow turbine intended to improve a blade efficiency of a turbine nozzle in turbine stages, i.e. pressure stage, placed in a passage with an expanded diameter formed in an axial direction of a turbine shaft (turbine rotor) in a turbine casing.

2. Related Art

Recently, in a motor employed for a power plant, for example, a steam turbine unit or system includes stages of a high pressure turbine, an intermediate pressure turbine, and a low pressure turbine for increasing outputs. The respective pressure turbines allow heat energy of steam supplied from a steam source to have an expansion work so as to obtain a rotating power. For the purpose of improving the power generation efficiency, it is essential to find the way how the expansion work is enhanced in the respective turbine stages for obtaining the rotating power. Specifically, the high pressure turbine is expected to bear more loads to increase the steam pressure for the expansion work compared with the intermediate and low pressure turbines.

Due to the high proportion of the work supplied by the high pressure turbine to that of the entire steam turbine, the improvement of the output per high pressure turbine stage may be significant for improving the output of the entire turbine unit.

In a generally employed high pressure turbine, a plurality of turbine stages are arranged in a row for allowing the steam that flows in the axial direction of the turbine shaft to have the expansion work. The aforementioned high pressure turbine is called as an axial flow type turbine.

The turbine stage is formed by combining cascaded turbine nozzles in a circumferential direction of the turbine shaft, and turbine rotor blades corresponding to the cascaded turbine nozzles.

A nozzle cascade constituting a generally employed axial flow turbine among the turbines formed by combining the turbine nozzles and the turbine rotor blades is shown in FIG. 2. Referring to FIG. 2, a plurality of nozzle blades 10 are supported to be placed between an inner (diaphragm) ring 11 and an outer (diaphragm) ring 12 in the circumferential direction of a turbine shaft, not shown. In the high pressure turbine at a relatively low blade height, a secondary flow loss is a dominant cause to reduce the internal efficiency of the turbine. Within an annular passage of the turbine as shown in FIG. 2, a secondary vortex 16 is generated by a hydrodynamic load 15 that causes the fluid to flow from a ventral side at a high blade surface pressure to a back side at a low pressure around an inner radial wall surface 13 and an outer radial wall surface 14 of the nozzle blade 10. The secondary flow loss is considered to be caused by the secondary vortex 16. As shown in FIG. 3 that represents an energy loss distribution in the direction of the height of the nozzle blade 10, high energy loss areas generally distribute around the inner and the outer radial wall surfaces 13 and 14, respectively. Further, since the height direction range of the area hardly changes irrespective of the increase in the blade height, degradation of the efficiency owing to the secondary flow loss is reduced as the blade height increases.

A turbine nozzle having the nozzle blade 10 curved toward an outlet side (which is hereinafter referred to as a curved nozzle) has been widely used for the purpose of reducing the secondary flow loss.

FIG. 4 shows a configuration of a generally employed curved nozzle. One of reference values for defining the curved configuration is represented by a curvature range in the blade height direction. Further, there are several methods for setting the curvature range including a typical method in which the curvature of a center of the blade height is set to a maximum value such that the nozzle blade is entirely curved over a whole range in the blade height direction, and a similarity expansion is made as the increase in the blade height. In this case, the absolute value of the curvature range changes as the blade height varies.

Meanwhile, the use of the curved nozzle may cause an adverse effect to deteriorate the nozzle blade performance at the center of its height, counteracting the improvement of the performance achieved by reducing the secondary loss. In this case, the curved configuration serves to press the fluid against the inner and outer radial wall surfaces 13 and 14 on the inner and outer rings 11 and 12 to suppress the secondary flow loss. On the other hand, the fluid flows at the reduced flow rate around the center of the nozzle blade in the height direction, which is supposed to be unaffected by the secondary loss, and accordingly exhibits the excellent performance.

FIG. 5 shows each of changes in the loss distribution of the curved nozzle and the normal nozzle with no curvature.

In the case where the blade height is at a low level, the effect by the secondary flow may be suppressed. The performance of the nozzle blade may be expected to be improved over its entire height. However, in the generally configured nozzle blade in which the curvature range increases as the increase in the blade height, the adverse effect owing to the reduced flow rate of the fluid at the center of the nozzle blade height may further be worsened. This may deteriorate the improvement of the entire performance of the curved nozzle.

Publication of PCT Japanese Translation Patent Publication No. 2002-517666 has proposed, as a method of improving the above problem, a method of forming the curved nozzle at the limited area around the inner and outer radial wall surfaces 13 and 14 on the inner and outer rings 11 and 12 with respect to the formation of a cross section of the flow passage defined by adjacent turbine nozzles.

In the disclosed method, the center of the nozzle blade height has no curvature area, which is expected to provide the effect for suppressing the performance degradation caused by the reduction in the flow rate around the center of the nozzle blade height compared with the case in which the nozzle blade is curved over the entire height. In the disclosed method, the curvature range is defined as the proportion of the blade height. The curvature range may be increased as the blade height increases, and accordingly the performance improvement is deteriorated as the flow rate at the center of the nozzle blade height reduces.

Conversely, in the case where the blade height is at the low level, the curvature range is reduced. However, as a secondary flow area in almost a constant range exists irrespective of the blade height, the effect for suppressing the secondary flow cannot be sufficiently obtained owing to insufficient curvature range.

As described above, the loss caused by the secondary vortex generated around the wall surface in a base portion and a tip portion of the turbine nozzle has been considered as the main cause for reducing the internal efficiency of the high pressure turbine at a relatively low blade height.

It is well known that the curved nozzle has been widely used for the purpose of reducing the secondary flow loss. The curvature range in the blade height direction is one of reference values that indicate the configuration, and several methods have been proposed for determining such curvature range. In one of those methods, the nozzle blade is curved over its entire height so as to make a similarity expansion as the increase in the blade height.

With the thus configured curved nozzle, the fluid is pressed against the wall surface around the upper and lower wall surfaces to suppress the secondary flow loss. However, the flow rate of the fluid is reduced at the center of the blade height, thus degrading the excellent performance of the center area which has not been affected by the secondary flow, thus deteriorating improvement of the entire performance.

In the general method where the absolute value in the curvature range changes in accordance with the blade height even if the range influenced by the secondary flow loss hardly changes irrespective of the blade height, the flow rate distribution at the outlet of the turbine nozzle is found disproportionately at the area especially around the wall surface of the inner and the outer rings 11 and 12 as the blade height increases. This may further worsen the adverse effect to the curved nozzle as described above.

The above-described PCT Japanese Translation Patent Publication No. 2002-517666 discloses a method of curving the configuration of the passage defined by the adjacent turbine nozzles only at the portion around the upper and lower wall surfaces on the inner and the outer rings 11 and 12 for solving the aforementioned problem. It is considered that the use of the configuration limiting the curvature range to the portion around the upper and lower wall surfaces on the inner and outer rings 11 and 12 in the blade height direction may suppress the decrease in the flow rate of the fluid at the center of the blade height while suppressing the secondary flow loss. The disadvantage of the nozzle blade curved over the entire height, thus, may be compensated. In this method, the curvature range is defined as the proportion of the blade height.

In the case where the blade height is at the high level, the curvature range is expanded. This may fail to completely eliminate the adverse effect caused by the decrease in the flow rate of the fluid at the center of the blade height. In the case where the blade height is at the low level, the curvature range is reduced. In this case, the effect for suppressing the secondary loss cannot be sufficiently obtained owing to insufficient curvature range because the area influenced by the secondary loss is ranged at a height that is almost kept constant.

SUMMARY OF THE INVENTION

Therefore, an object of the present invention is to substantially eliminate defects or drawbacks encountered in the prior art mentioned above and to provide an axial flow turbine using a turbine nozzle capable of suppressing the secondary flow loss caused by the secondary vortex generated around the inner and outer radial wall surfaces of the nozzle blade supported at the inner and outer rings and allowing the fluid to flow to the center of the nozzle blade height at higher rates so as to further improve the performance.

The above and other objects can be achieved according to the present invention by providing, in one aspect, an axial flow turbine provided with a stage composed of a turbine nozzle and a turbine rotor blade arranged in an axial flow direction, in which both end portions of a nozzle blade of the turbine nozzle are supported by a diaphragm inner ring and a diaphragm outer ring, and a flow passage is formed with its diameter expanded from an upstream stage to a downstream stage, wherein trailing edges at ends of the nozzle blade supported by the diaphragm inner ring and the diaphragm outer ring are curved to an outlet side, and an intermediate portion between the trailing edges is formed to be straight.

In another aspect of the present invention is to provide an axial flow turbine, comprising a casing, and a plurality of stages, provided in the casing, comprising turbine nozzles and turbine blades, respectively, wherein both ends of the nozzles of each stages are supported between a diaphragm inner ring and a diaphragm outer ring, wherein a flow passage in the stages is formed with a diameter expanded from an upstream side to a downstream side, wherein trailing edges of at least one of the nozzles are curved as a curvature to an outlet side of the flow passage around both ends thereof, and an intermediate portion between both ends of the trailing edge is formed to be straight.

In a preferred embodiment of the above aspects, when a curvature height at an end portion supported by the diaphragm outer ring of the curvature toward the outlet side is set to Ht, and a curvature height at an end portion supported by the diaphragm inner ring of the curvature toward the outlet side is set to Hr, a relationship of $Ht \geqq Hr$ may be satisfied.

The curvature height at the end portion supported by the diaphragm outer ring set to Ht is in a range expressed by a relationship of $5\ mm \leqq Ht \leqq 50\ mm$.

The curvature height at the end portion supported by the diaphragm inner ring set to Hr is in a range expressed by a relationship of $5\ mm \leqq Hr \leqq 40\ mm$.

When a pitch between adjacent curvatures at the diaphragm outer ring support ends supported by the diaphragm outer ring is set to Tt, and a pitch between adjacent curvatures at the diaphragm inner ring support ends supported by the diaphragm inner ring is set to Tr, a relationship of $Tt > Tr$ may be satisfied.

A center of the nozzle blade in a direction of a height is set as a position of a maximum value of a throat pitch ratio between the trailing edge of the nozzle blade and a back side of the adjacent nozzle blade.

The nozzle blade of the above-described type may be applied to a high pressure turbine.

The nozzle blade of the above-described type may be applied to a high pressure turbine for all stages.

The nozzle blade of the above-described type may be applied to a nozzle blade, whose position of the trailing edge is inclined toward a direction of the axial flow from the root side to the tip side.

The nozzle blade of the above-described type may be applied to a nozzle blade, whose position of the trailing edge is curved toward a direction of the axial flow from the root side to the tip side.

In the axial flow turbine according to the present invention of the characters mentioned above, the trailing edges at support ends of the nozzle blade supported at a diaphragm inner ring and a diaphragm outer ring are curved toward the outlet side, the intermediate portion of the trailing edge is formed straight such that the range of the curvature height at the diaphragm outer ring support end is set to be higher than that at the diaphragm inner ring support end. Since the fluid is allowed to flow to the center of the blade height at higher rates, the secondary flow loss generated at both support ends of the nozzle blade is suppressed, and more expansion work is made under the state where the flow rate of the fluid is increased for further improving the nozzle performance.

The nature and further characteristic features of the present invention will be made more clear from the following descriptions with reference to the accompanying drawings.

DESCRIPTION OF THE PREFERRED EMBODIMENTS

Figure 1:
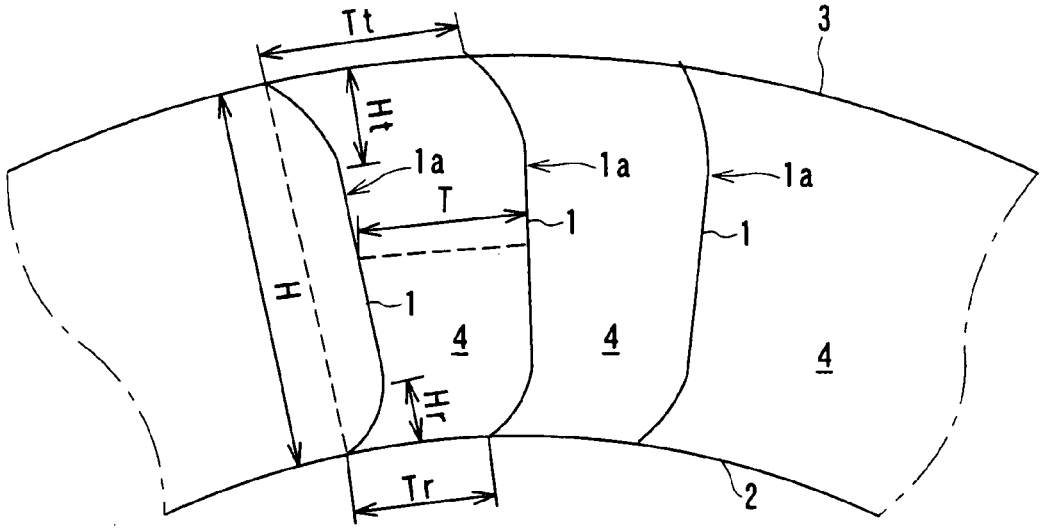
FIG. 1 is a conceptual view representing a nozzle blade applied to an axial flow turbine according to the present invention as viewed from an outlet of the nozzle blade.
Figure 2:
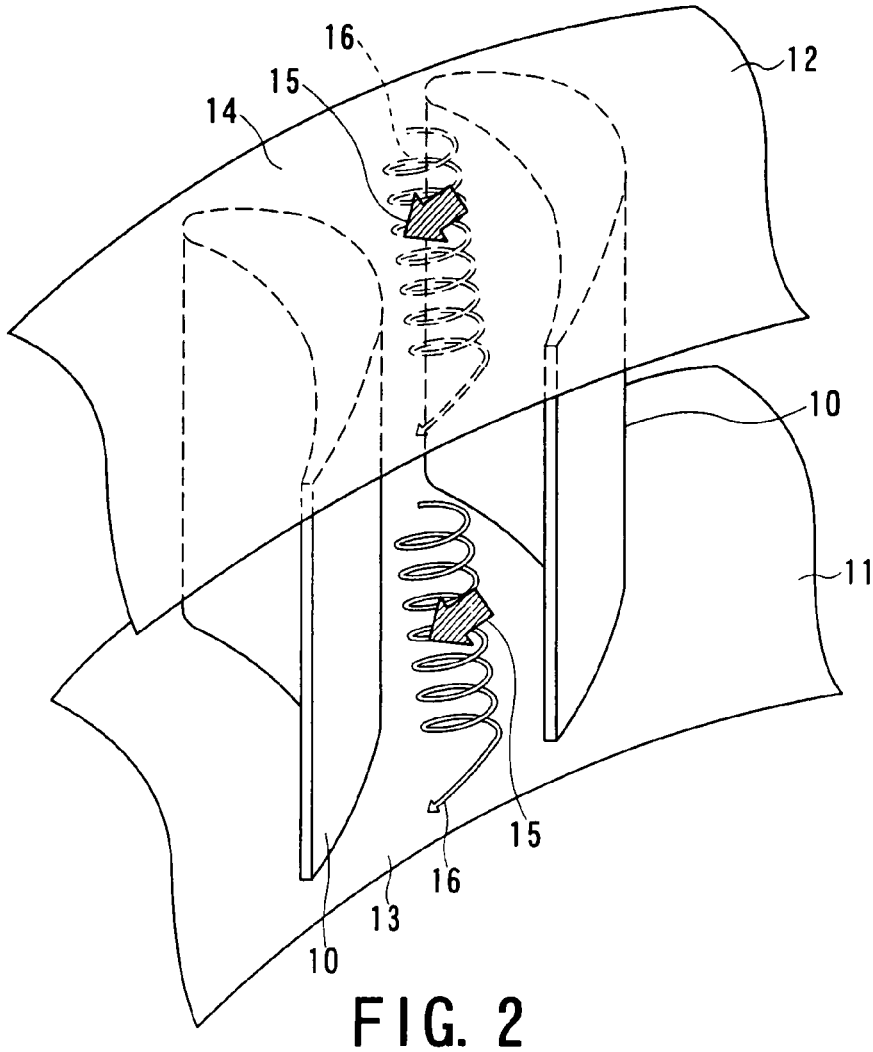
FIG. 2 is a view representing a behavior of the fluid passing through the nozzle blade in a generally (i.e. conventionally) employed axial flow turbine.
Figure 3:
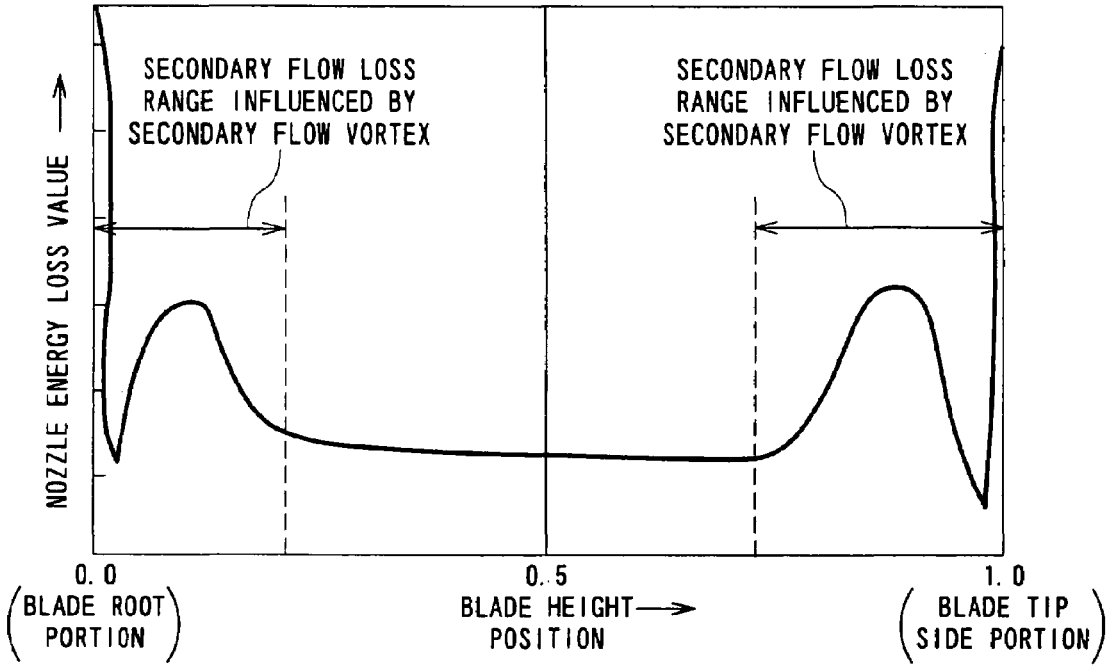
FIG. 3 is a graph representing an energy loss of the nozzle blade applied to the generally employed axial flow turbine.
Figure 4:
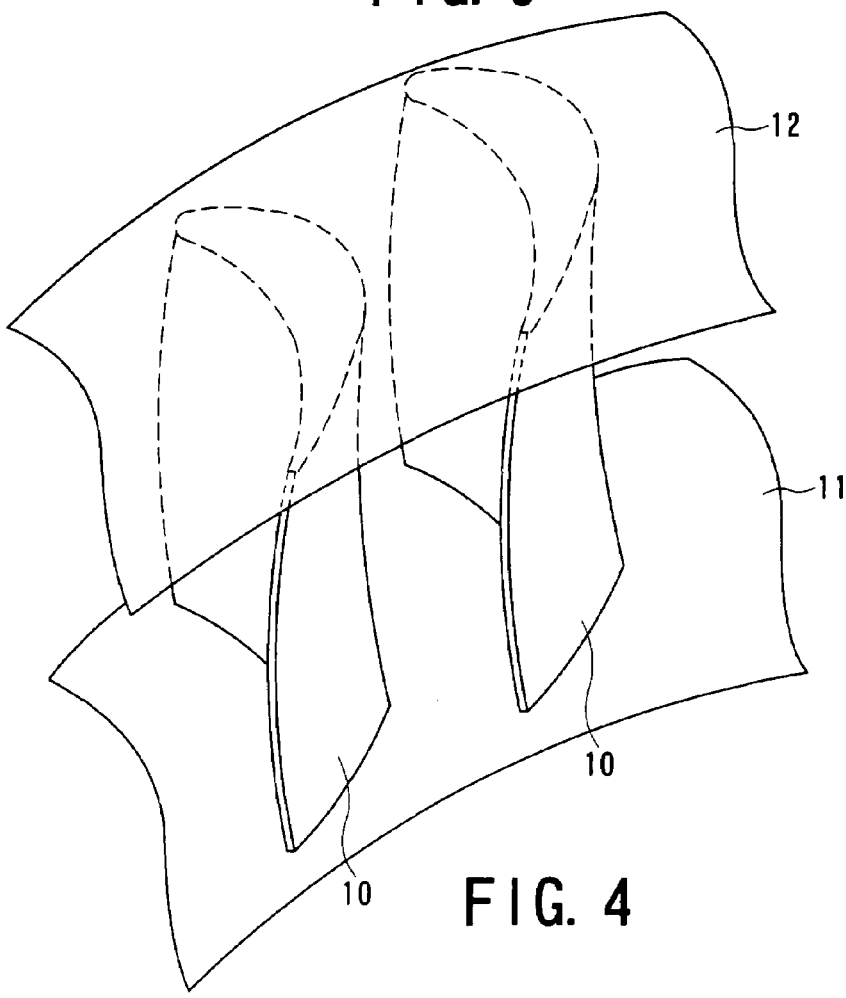
FIG. 4 is a conceptual view representing a nozzle blade applied to the generally employed axial flow turbine.
Figure 5:
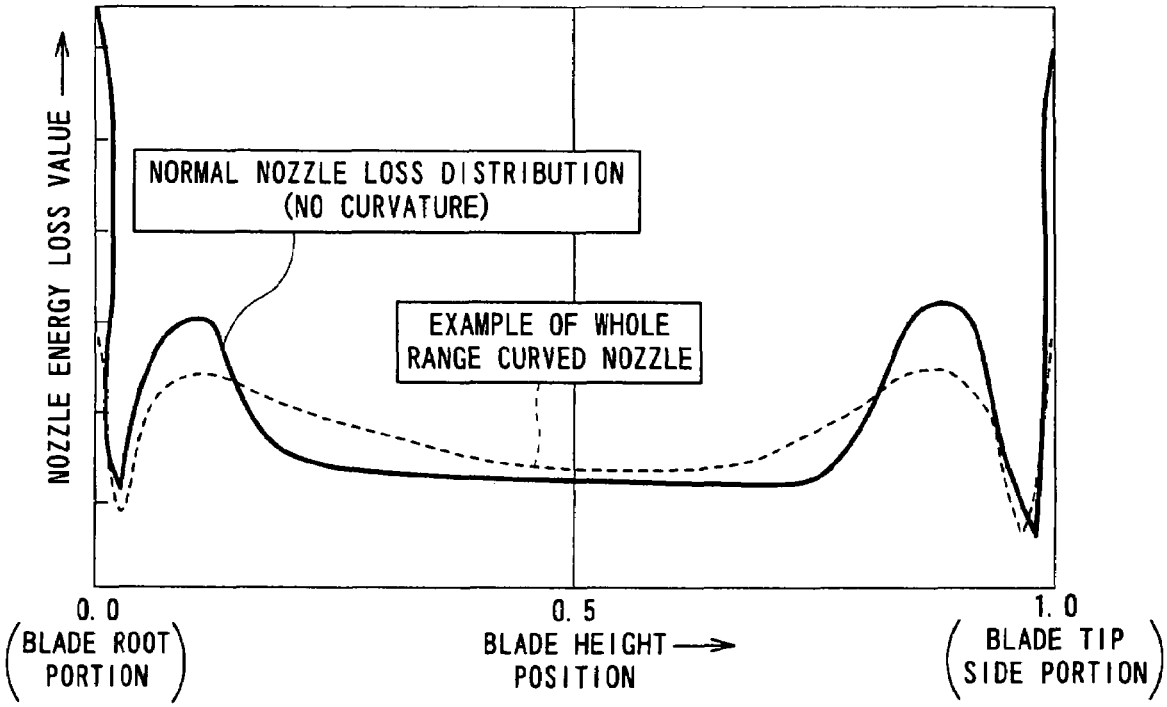
FIG. 5 is a graph representing an energy loss of a nozzle blade of another type applied to the generally employed axial flow turbine.

An embodiment of an axial flow turbine according to the invention will be described referring to the drawings and reference numerals thereon.

Figure 14:
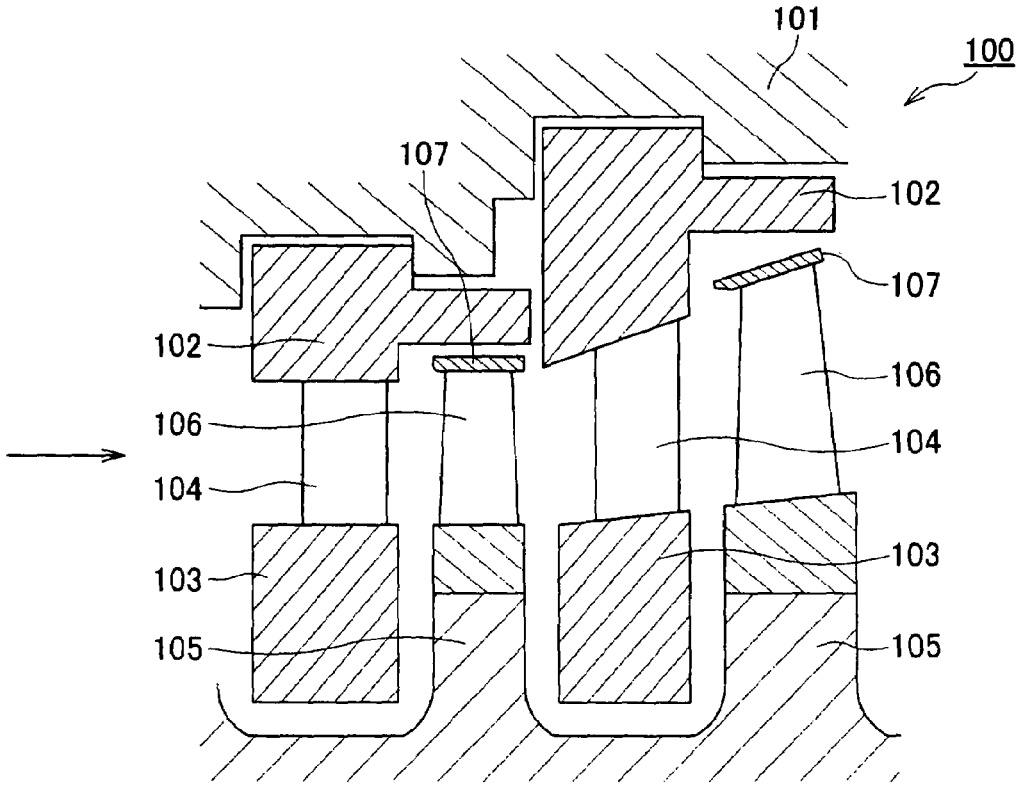
FIG. 14 is an illustrated sectional view of an axial flow turbine to which the present invention is applicable.

First, FIG. 14 shows stages of the axial flow turbine 100 provided with nozzle blades 104. The nozzle blades 104 are fixed to an outer (diaphragm) ring 102 and an inner (diaphragm) ring 103, which are secured in a turbine casing 101, to form nozzle blade passages. A plurality of turbine movable blades 106 are disposed on the downstream side of the respective blade passages. The movable blades 106 are implanted on the outer periphery of a rotor disc, i.e. wheel, 105 in a row at predetermined intervals. A cover 107 is attached on the outer peripheral edges of the movable blades 106 in order to prevent leakage of a working fluid in the movable blades.

In FIG. 14, the working fluid, i.e. stream "S", flows from the right-hand side (upstream side) of the turbine in the figure towards the left-hand side (downstream side).

FIG. 1 is an illustration of the turbine nozzle of the axial flow turbine according to the present invention, and with reference to FIG. 1, in the axial turbine, turbine (pressure) stages, not shown, formed by combining turbine nozzles and turbine rotor blades are arranged along a circumference of a turbine shaft. The turbine stages arranged along the circumference of the turbine shaft are provided toward an axial direction of the turbine shaft such that a fluid passage extends to have a diameter expanded from the upstream side to the downstream side.

Referring to FIG. 1, in an annular passage 4 defined by a diaphragm outer ring 3 and a diaphragm inner ring 2, a plurality of nozzle blades 1 each having a blade height H are arranged in a row in a circumferential direction, and spaced at a pitch T between center portions of the blade heights of adjacent nozzle blades.

The nozzle blade 1 as a curved nozzle has a trailing edge 1*a* of the cross section of the blade curved circumferentially toward the outlet side. It is formed to have a curvature height range in the blade height direction at the diaphragm inner ring set to Hr (mm), the curvature height range in the blade height direction at the diaphragm outer ring set to Ht (mm), and other curvature height range set to H−(Hr+Ht) which is kept straight.

Figure 6:
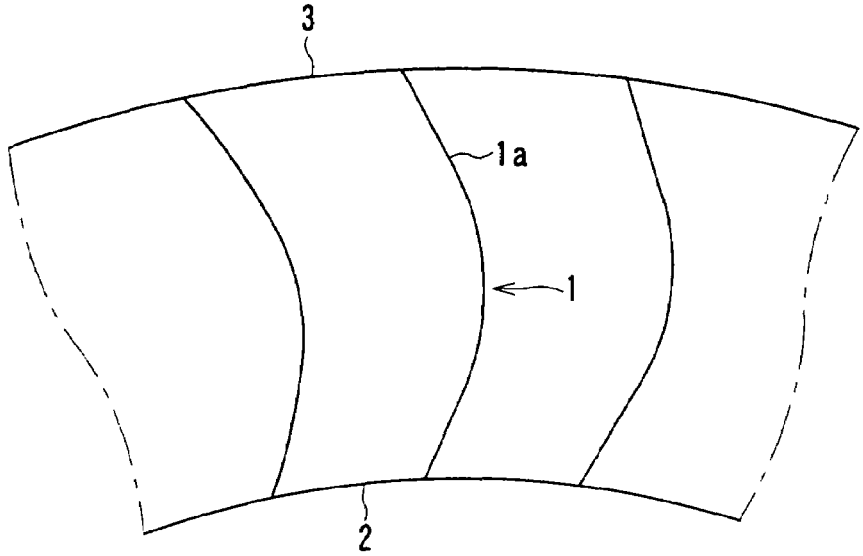
FIG. 6 is a conceptual view representing a nozzle blade of another type applied to the generally employed axial flow turbine.
Figure 7:
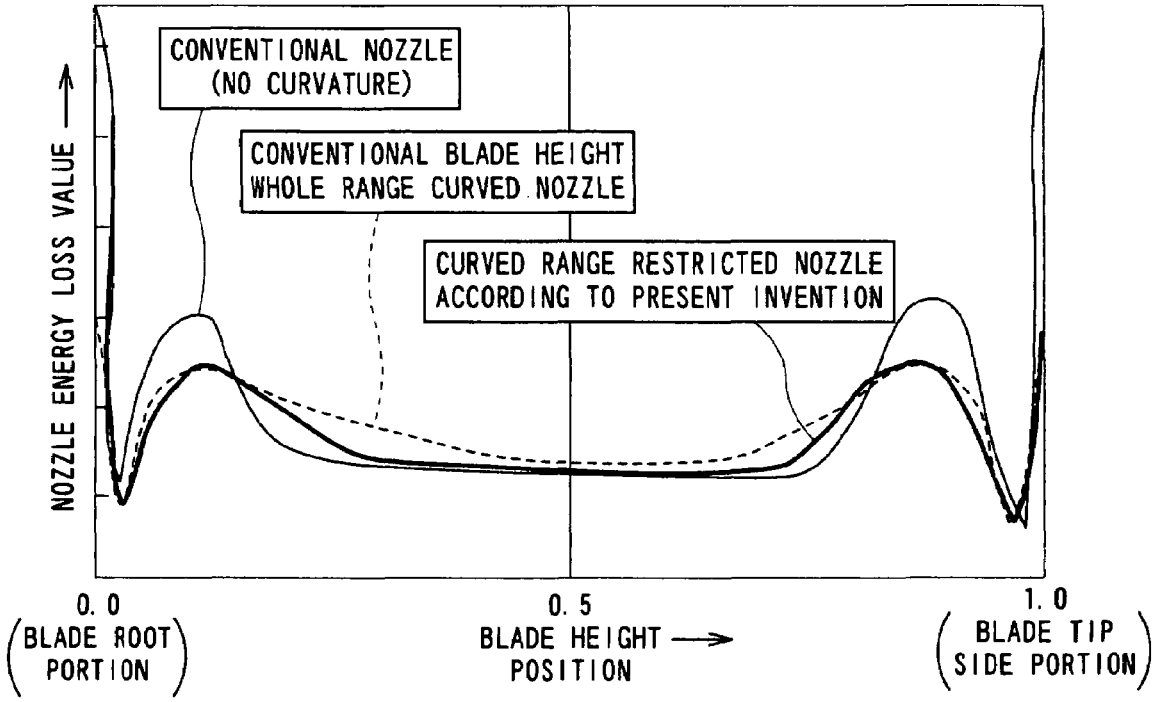
FIG. 7 is a graph representing a comparison of the energy loss of the nozzle blade applied to the generally employed axial flow turbine with the one applied to the axial flow turbine according to the present invention.

A generally (conventionally) employed turbine nozzle of compound lean type having entire blade height curved as shown in FIG. 6 is compared with the above-structured turbine nozzle of the axial flow turbine according to the present invention with respect to the energy loss value. In the generally employed turbine nozzle having the entire blade height curved, the maximum energy loss value caused by the secondary flow loss around the upper and lower wall surfaces (base and tip portions of the blade) of the diaphragm inner and outer rings 2 and 3 is reduced as shown in FIG. 7, but the secondary flow loss at the center of the turbine height is increased. FIG. 6 is a view that represents the trailing edge 1*a* of the nozzle blade 1 supported at the diaphragm inner and outer rings 2 and 3 when seen from the outlet of the turbine nozzle.

Meanwhile, in the axial flow turbine according to the present invention, the increase in the secondary flow loss is suppressed not only around the upper and lower wall surfaces (base and tip portions) of the diaphragm inner and outer rings 2 and 3 but also at the center of the nozzle blade height.

It is to be understood that setting the curvature height range to the portion around the diaphragm inner and outer rings 2 and 3 allows the secondary flow loss to be reduced without need of curving the nozzle blade over the entire height thereof.

The range of the secondary flow loss expands as the increase in the pitch T between adjacent nozzle blades 1, 1. Assuming that the pitch between the tip portions of the adjacent nozzle blades 1, 1 is set to Tt, and the pitch between the base portions thereof is set to Tr, the relationship of Tr<Tt is established.

Referring to the nozzle energy loss distribution, under the influence of the secondary vortex, the energy loss range at the tip portion of the nozzle blade 1 becomes wider than that at the base portion thereof.

In the embodiment, the curvature height range Hr of the base portion of the nozzle blade and the curvature height range Ht of the tip portion of the nozzle blade have a relationship of Ht≧Hr.

Figure 8:
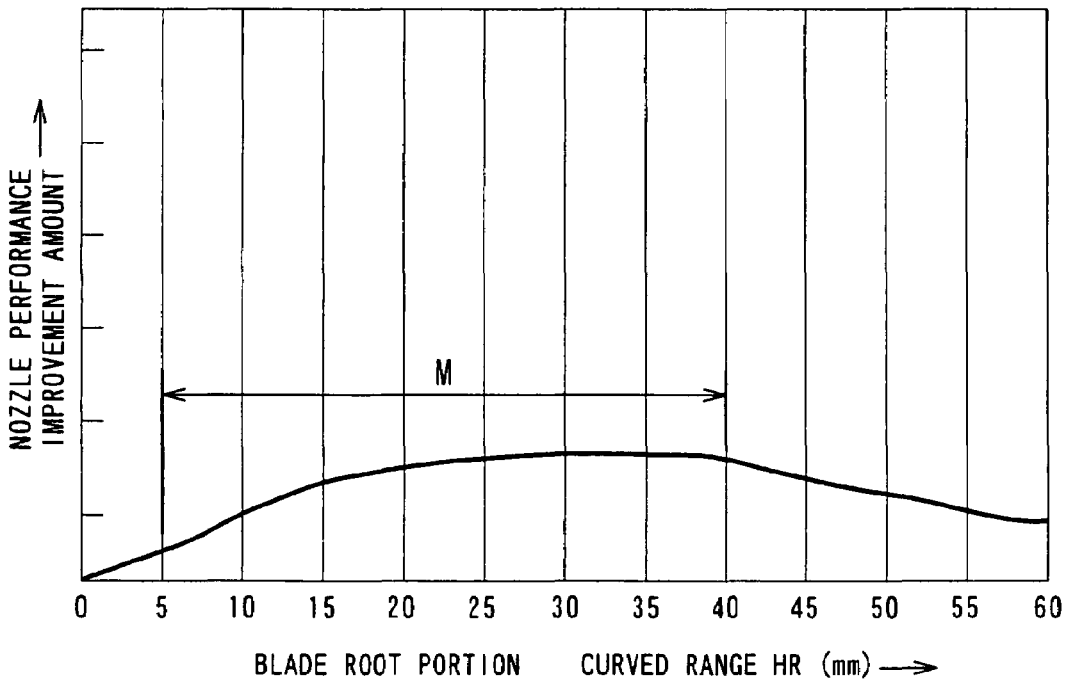
FIG. 8 is a graph representing a reference value indicating a nozzle efficiency improvement in the case where a curvature is formed on a base portion of the nozzle blade applied to the axial flow turbine according to the present invention.

FIG. 8 is a graph representing a reference value indicating the nozzle performance improvement resulting from changing the curvature height range Hr of the base portion of the nozzle blade 1 independently.

The graph shows that the reference value indicating the nozzle performance improvement is kept low unless the curvature height range M, that is 5 mm at minimum, has to be ensured and the reference value of the nozzle performance improvement is reduced even if the curvature height range is set to be equal to 40 mm or wider.

Figure 9:
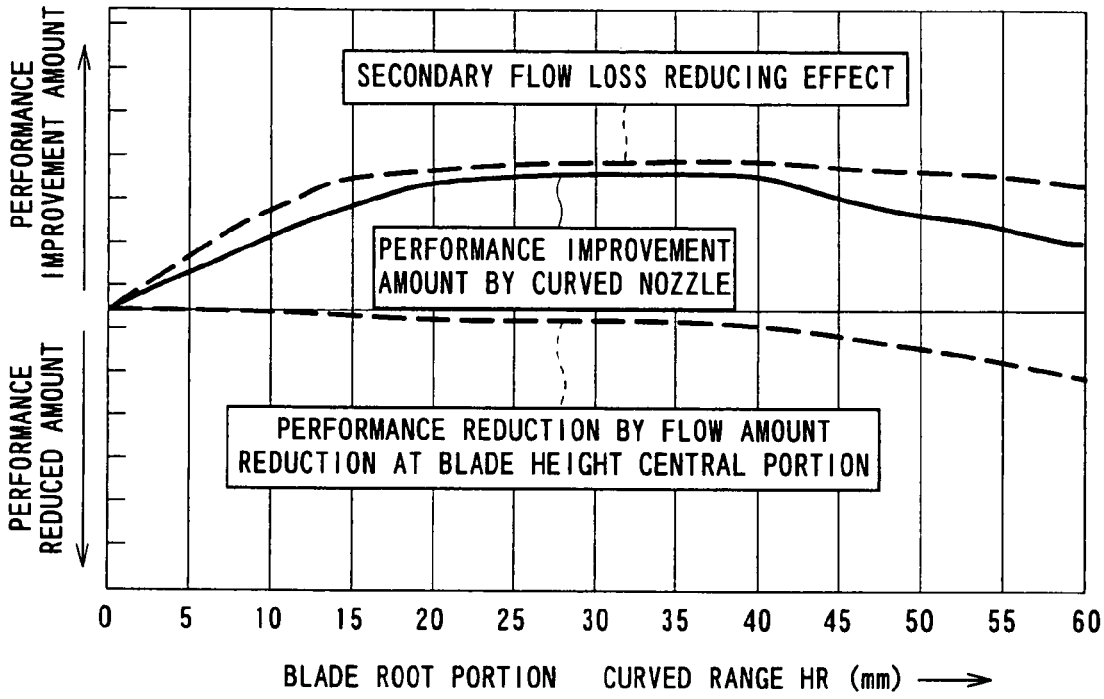
FIG. 9 is a view representing changes in the nozzle performance owing to the respective causes when the curvature is formed on the base portion of the nozzle blade.

The secondary flow loss caused by the secondary vortex is considered to have a tendency asymptotic to a predetermined lower limit value in the last result no matter how the curvature height range Hr of the base portion of the nozzle blade is increased as shown by the graph representing the reference value of the nozzle performance improvement in FIG. 9. The excessive curvature height range may be considered as a dominant cause that negatively works for reducing the nozzle efficiency resulting from the decrease in the flow rate at the center of the blade height.

Figure 10:
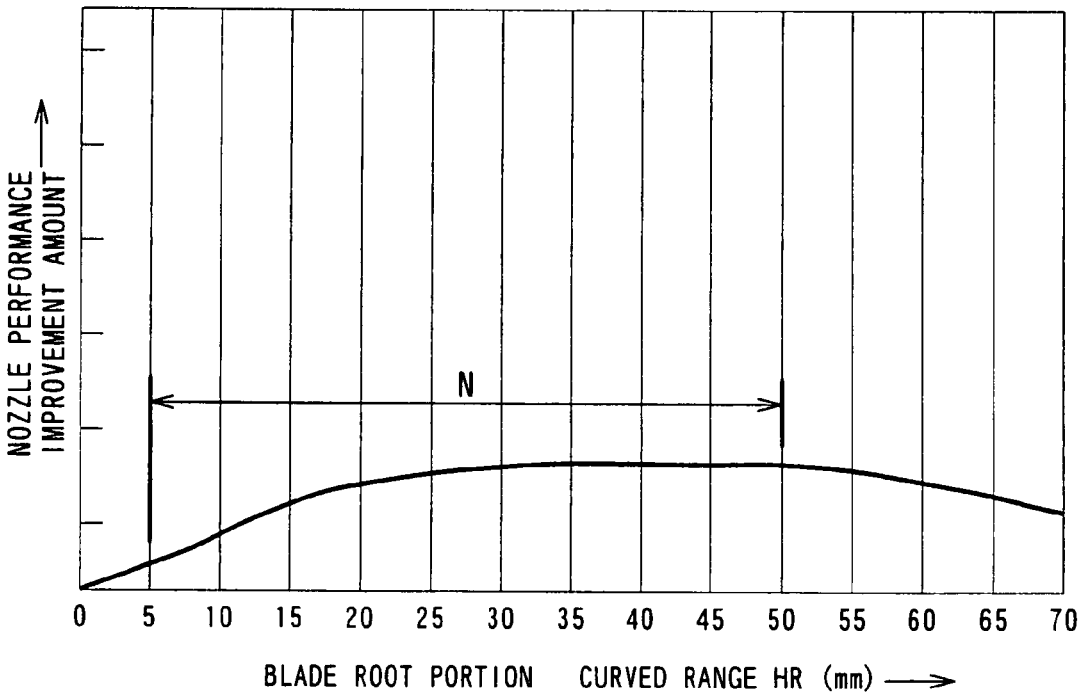
FIG. 10 is a graph representing a reference value indicating a nozzle efficiency improvement in the case where a curvature is formed on a tip portion of the nozzle blade applied to the axial flow turbine according to the present invention.

FIG. 10 is a graph representing a reference value indicating the nozzle performance improvement resulting from changing the curvature height range Ht of the tip portion of the nozzle blade 1 independently.

The graph shows that the reference value indicating the nozzle performance improvement is kept low unless the curvature height range N, that is 5 mm at minimum, has to be ensured, and the reference value indicating the nozzle performance improvement is reduced even if the curvature height range is set to be equal to 50 mm or wider.

In the case where a curvature at the tip portion of the nozzle blade is relatively wider than that at the base portion of the nozzle blade, the nozzle performance may be improved. Since the pitch between the tip portions of the nozzle blades 1 and 1 is wider than that between the base portions thereof, the resultant secondary flow range becomes wider accordingly.

Figure 11:
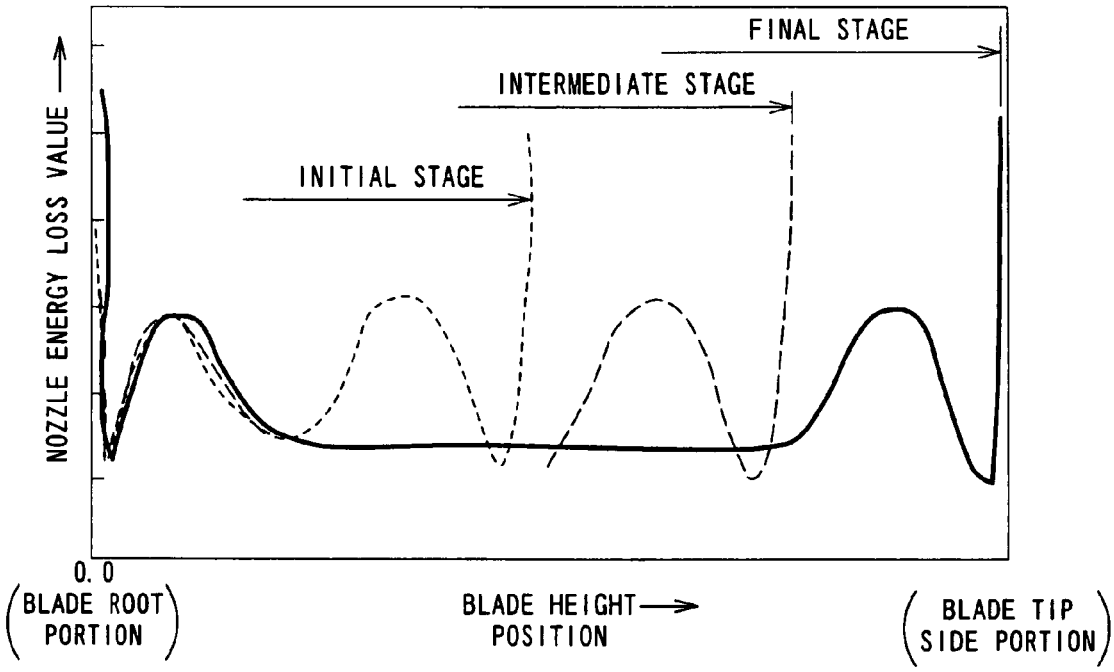
FIG. 11 is a view showing a relationship of the respective nozzle blade heights at the initial stage, intermediate stage, and last stage of the turbines with respect to the nozzle energy loss.

FIG. 11 is a graph representing the relationship between the nozzle energy loss and values of the nozzle blade length (nozzle height) at the initial stage, intermediate stage, and last stage of the high pressure turbines, respectively, which are changed for analytical purposes.

The graph shows the existence of a little difference in the secondary flow loss range that changes depending on the blade length between the base portion and the tip portion of the nozzle blade 1.

In the case where the nozzle blade having a curvature is applied to all the stages of the high pressure turbines, if the respective secondary flow influence ranges at the base and tip portions of the nozzle blade 1 are set at the stage at a predetermined blade height (blade length) based on the results of a three-dimensional fluid analysis and various test results, the curvature range of the nozzle blade 1 is not required to be changed even in the case of the application to the stage at the different blade height.

The use of the aforementioned features may save the effort for searching a curvature of the nozzle blade 1 appropriate for the respective stages of the axial flow turbines among a plurality of stages each having a detailed geometrically different condition.

Intending to reduce the secondary flow loss sufficiently for all the stages of the axial flow turbines according to the embodiment, the curved nozzle having the center of the blade height hardly influenced by the secondary flow may suppress degradation of the nozzle performance.

If the curvature range of the nozzle blade 1 is defined as the proportion of the blade height, the minimum curvature range that has been determined as being required may be changed at the respective stages. Specifically, when the blade height is at the low level, the curvature range is reduced, and on the other hand, when the blade height is at the high level, the curvature range is expanded. If the aforementioned curvature range setting is applied to the nozzle blade 1 having the secondary flow influence range hardly changed in accordance with the blade height, the curvature range becomes insufficient in the case of the low level of the blade height, and the curvature range becomes excessive in the case of the high level of the blade height. There may be the case where the value that has been determined as being the best at a predetermined blade height cannot be used for other stages.

In the described embodiment, the performance of the nozzle blade 1 with the curvature according to the embodiment may be improved even if the blade of the other configuration is combined therewith.

Figure 12:
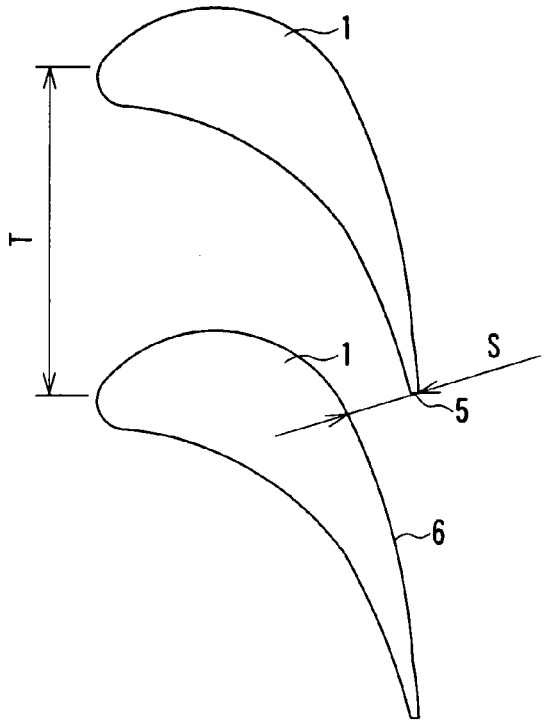
FIG. 12 is an explanatory view showing a nozzle throat ratio between adjacent nozzle blades.

For example, as shown in FIG. 12, the performance of the nozzle 1 may be maintained high by increasing the distribution of the flow rate at the outlet in the nozzle blade 1 where a maximum value of a nozzle throat ratio S/T, that is, the ratio of the shortest distance S between the trailing edge 1*a* of the nozzle blade 1 and the back side 6 of the adjacent nozzle blade 1 to the pitch T between adjacent nozzle blades 1 and 1 is set for the center of the blade height.

Figure 13:
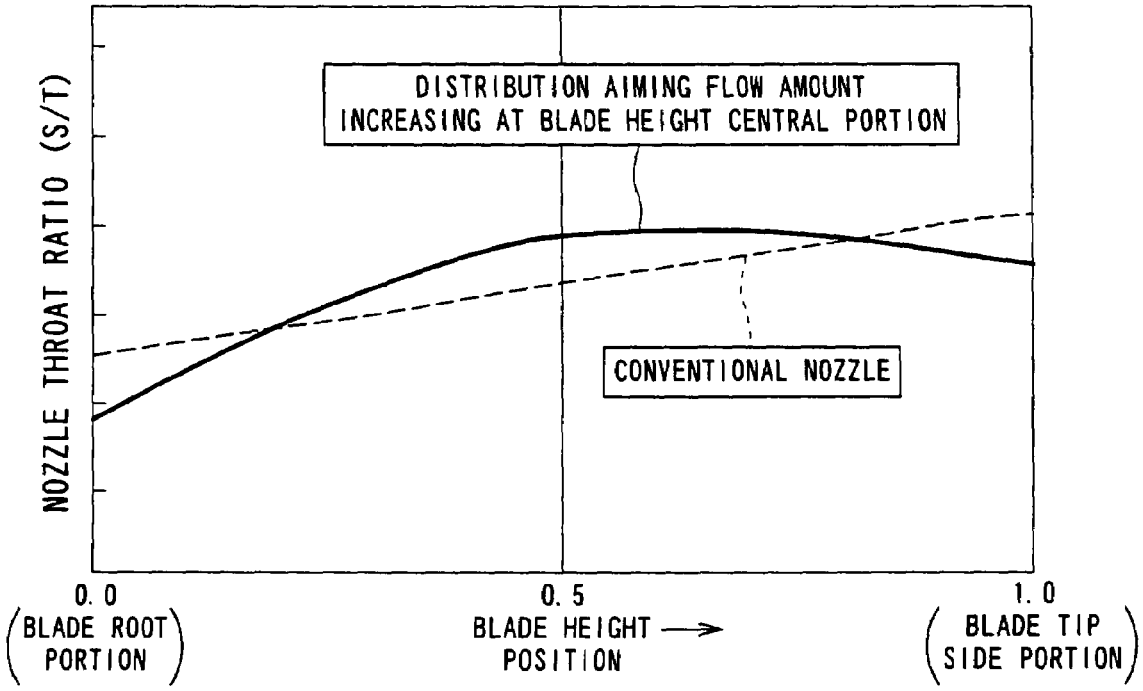
FIG. 13 is a graph representing a comparison of the flow rate of the fluid passing through the throat from the base portion to the tip portion of the nozzle blade applied to the generally employed turbine with the one applied to the axial flow turbine according to the present invention.

If the nozzle blade with the curvature according to the described embodiment is combined with the aforementioned arrangement of the blades, the reduction in the flow rate of the fluid at the center of the blade height may be compensated for further higher performance improvement in comparison with the generally employed nozzle blade as shown in FIG. 13.

In the embodiment, the trailing edges at both support ends of the nozzle blade supported by the diaphragm inner and outer rings are curved toward the outlet side, and the intermediate portion interposed between the trailing edges is kept straight such that the curvature height range at the diaphragm outer ring support end is higher than the one at the diaphragm inner ring support end. This makes it possible to allow more expansion work to be performed under the state where the flow rate of the fluid at the center of the blade height is increased while suppressing the secondary flow loss, thus further improving the nozzle performance.

Further, the nozzle blade having the curvature mentioned hereinabove may be applicable to conventionally existing axial flow turbines. For example, the present invention may be applied to a nozzle blade, whose position of the trailing edge is inclined toward a direction of the axial flow from the root side to the tip side. Further, the present invention may also be applied to a nozzle blade, whose position of the trailing edge is curved toward a direction of the axial flow from the root side to the tip side.

It is further to be noted that the present invention is not limited to the described embodiments and many other changes and modifications may be made without departing from the scopes of the appended claims.

This application claims priority from Japanese Patent Application 2005-104056, filed Mar. 31, 2005, which is incorporated herein by reference in its entirety.

What is claimed is:

1. An axial flow turbine, comprising:

a casing; and a plurality of stages, provided in the casing, comprising turbine nozzles and turbine blades, respectively, wherein both ends of the nozzles of each stage are supported between a diaphragm inner ring and a diaphragm outer ring;

wherein a flow passage in the stages is expanded from an upstream side to a downstream side, and trailing edges of at least one of the nozzles are curved as a curvature to an outlet side of the flow passage around both ends thereof, and an intermediate portion between both ends of the trailing edge is formed to be straight.

2. The axial flow turbine according to claim 1, wherein a height of the curvature of the trailing edge at an end portion of the diaphragm outer ring is set to Ht, and a height of the curvature of the trailing edge at an end portion of the diaphragm inner ring is set to Hr so as to satisfy a relationship of $Ht \geqq Hr$.

3. The axial flow turbine according to claim 2, wherein the height Ht is in a range expressed by a relationship of $5\ mm \leqq Ht \leqq 50\ mm$.

4. The axial flow turbine according to claim 2, wherein the height Hr is in a range expressed by a relationship of $5\ mm \leqq Hr \leqq 40\ mm$.

5. The axial flow turbine according to claim 2, wherein the nozzle provided with the trailing edge is applied to a high pressure turbine.

6. The axial flow turbine according to claim 2, wherein the nozzle provided with the trailing edge is applied to all of the stages of a high pressure turbine.

7. The axial flow turbine according to claim 1, wherein a pitch between adjacent curvatures of the trailing edges at a side of the diaphragm outer ring is set to Tt, and a pitch between adjacent curvatures of the trailing edges at a side of the diaphragm inner ring is set to Tr so as to satisfy a relationship of $Tt > Tr$.

8. The axial flow turbine according to claim 1, wherein the nozzle provided with the trailing edge is applied to a high pressure turbine.

9. The axial flow turbine according to claim 1, wherein the nozzle provided with the trailing edge is applied to all of the stages of a high pressure turbine.

* * * * *